United States Patent [19]

Tedeschi

[11] 4,114,006

[45] Sep. 12, 1978

[54] MERCURY-WETTED SEALED CONTACT SWITCH

[75] Inventor: Anthony Tedeschi, Raytown, Mo.

[73] Assignee: Western Electric Co., Inc., New York, N.Y.

[21] Appl. No.: 793,325

[22] Filed: May 3, 1977

[51] Int. Cl.[2] ..... H01H 1/08; H01H 1/26

[52] U.S. Cl. ..... 200/234; 200/236; 335/58

[58] Field of Search ..... 200/234, 235, 236, 246, 200/283, 288; 335/55, 58, 104, 154, 151, 193

[56] References Cited

U.S. PATENT DOCUMENTS

| | | | |
|---|---|---|---|
| 2,406,036 | 8/1946 | Pollard, Jr. | 335/58 |
| 2,445,406 | 7/1948 | Pollard, Jr. | 335/58 |
| 2,732,459 | 1/1956 | Pollard, Jr. | 200/234 |
| 2,914,634 | 11/1959 | Koda | 335/58 |

FOREIGN PATENT DOCUMENTS

| | | | |
|---|---|---|---|
| 1,764,884 | 11/1971 | Fed. Rep. of Germany | 335/58 |

*Primary Examiner*—Richard R. Stearns
*Attorney, Agent, or Firm*—W. O. Schellin

[57] ABSTRACT

The possibility of contact bounce in an electrical switch is minimized by transferring energy from an armature of the switch to a damping liquid. An arrangement for damping the armature by such a transfer is particularly suited for use with a mercury-wetted sealed contact switch. The switch includes first and second spaced terminals embedded at opposite ends of a cylindrical envelope. The armature is located in the space between the two terminals. It is hinged by a thin leaf spring at the first terminal and is normally positioned to form a gap with the second terminal. Operation of the switch to close and reopen the gap results from an application and a removal, respectively, of a magnetic field through the terminals and the armature. Mercury wets the contact points between the second terminal and the armature. The mercury is supplied from a pool located at the first terminal. To dampen the motion of the armature, a damping member is rigidly coupled to the armature and extends from the armature into the pool of mercury.

4 Claims, 3 Drawing Figures

MERCURY-WETTED SEALED CONTACT SWITCH

BACKGROUND OF THE INVENTION

1. Field of the Invention

This invention relates to electrical switches. More particularly, the invention relates to high speed electrical switches, the contacts of which have a tendency to bounce. The invention is described with respect to a mercury-wetted sealed contact switch as an illustrative embodiment of the invention.

2. Discussion of the Prior Art

Mercury-wetted sealed contact switches are in most instances not subject to contact bounce. A thin layer of mercury which wets their contact surfaces is sufficient to serve as a damper to the tendency of the contacts to bounce. However, in some switches including those which respond at frequencies close to the natural frequencies of their armatures, contact bounce can occur. U.S. Pat. No. 2,406,036 to Pollard, Jr. refers to the problem of contact bounce in relationship to a sealed contact device having a resiliently bouncing armature. The patent discloses a solution wherein a wetted mercury brake controls the movement of the armature.

The Pollard, Jr. patent disclosure relates to a slip joint in a wick transporting mercury from a pool at the bottom of the switch to its contacts in the upper portion of the switch. The joint is formed by two closely spaced parallel discs. The planes in which the discs lie are oriented substantially parallel to the direction in which the armature extends. The distance at which the discs are located from an apparent center of rotation of the armature is chosen to lie between the center and the contacts as a compromise to give high damping of the harmonic vibration and low damping of the functional operation.

The damping occurs when a resilient bending motion of the armature causes a pumping action on a quantity of mercury filling the space between the discs by capillary attraction. With one of the discs being mounted directly to the armature, the motion of the armature becomes damped. However, the disc and its supporting structure increases the mass and consequently the inertia of the armature.

A copending application, Ser. No. 793,123, filed on May 2, 1977, in the Patent and Trademark Office in the name of Asbell et al., discloses subject matter which is applicable to miniature mercury-wetted sealed contact switches. Because of a low mass of an armature in a miniature switch in comparison to larger switches, such a miniature switch is capable of quickly opening or closing in response to a command. Consequently, a substantial increase in the inertia of the armature of such a miniature switch could easily destroy a fast response time as an advantageous operating characteristic of the switch. It is therefore desirable to provide a damping structure for a switch armature which does not significantly affect the response time of the damped switch armature.

Also, a brake which damps harmonic vibrations of an armature tends to interfere with the functional motion of the armature operating close to its natural frequency. It is therefore desirable to provide an effective arrangement for neutralizing stored energy of the armature. This energy would otherwise tend to cause contact bounce.

SUMMARY OF THE INVENTION

According to the invention, vibrations of a switch armature are damped by a member which is rigidly coupled to the armature. The member extends from the armature past a pivot center of the armature into a supply of a damping liquid located opposite the armature across from its pivot center.

The invention applies particularly to a mercury-wetted sealed contact switch which includes a pair of terminals. The armature pivots about the pivot center into engagement with a stop to establish electrical contact between the terminals. The supply of damping liquid is a pool of mercury which is located at the base of the switch.

BRIEF DESCRIPTION OF THE DRAWING

Various features and advantages of the present invention will be more readily understood from the following detailed description read with reference to the accompanying drawing, in which.

DETAILED DESCRIPTION

General Considerations Relating to Mercury-Wetted Sealed Contact Switches

Figure 1:
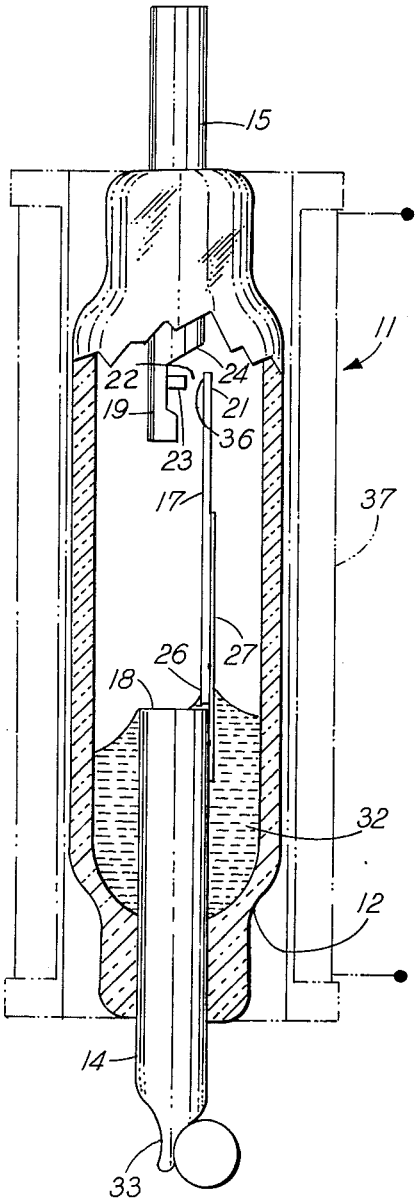
FIG.-1 (PRIOR ART)
FIG. 1 is an enlarged sectional view of a miniature sealed contact switch of the prior art.

FIG. 1, there is shown a prior art mercury-wetted sealed contact switch which is designated generally by the numeral 11. The switch 11 is of a type which advantageously can be modified by the present invention. However, as it will become apparent from the description below, the invention can also be used in conjunction with other type switches.

The switch 11 includes a glass envelope or sleeve 12 into which extend, from opposite directions, electrodes 14 and 15. Within the switch 11 the electrodes 14 and 15 are located in spaced relationship to function as normally unconnected or open terminals of an electric circuit, capable of sustaining a voltage difference.

An armature 17 bridges most of the space between the inner ends or terminals 18 and 19 of the electrodes 14 and 15. However, a free or unconnected end 21 of the armature normally rests in a position to form a gap 22 between itself, e.g., the end 21, and a contact 23 located on a formed side surface 24 of the terminal 19.

A lower end 26 of the armature is typically welded to a flexible leaf or reed spring 27 which, in turn, is welded to the terminal 18. The armature 17 is consequently electrically coupled to the terminal 18, and is only separated from the terminal 19 by the gap 22. Mechanically, the reed spring 27 restricts the motion of the lower end 26 of the armature. In that the reed spring 27 is free to flex, it permits the armature to pivot about a theoretical center or axis which corresponds substantially to the midpoint or the center of flexure of the spring 27.

The electrodes 14 and 15 are typically embedded by tubular openings at opposite ends of the sleeve 12. The glass clings to the electrodes in a gastight seal. The switch is further partially filled with a supply or pool of mercury 32 and hydrogen gas under pressure. A tubular inlet 33 extending through the electrode 14 is then sealed off by a compressive deformation of the electrode 14. This seal is further strengthened by a cross-wire weld.

The presence of the mercury 32 within the sleeve is known to have several advantages. The terminals 18 and 19, the armature 17, the spring 27, and particularly the contact 23 are formed of a material, which, when treated according to known practices, is wetted by the mercury 32 within the sleeve 12. A thin film of the mercury 32 travels along the armature 17 to its end 21. The armature 17 is typically formed from stock which is prepared with small longitudinal channels (not shown) to enhance the mercury transport mechanism by capillary attraction.

The switch 11 opens and closes as an inner surface 36 of the armature 17 moves into and out of engagement with the contact 23. In engaging the contact 23, the inner surface 36 of the armature becomes in effect a matching contact 36 on the armature 17. The closing and reopening action of the switch 11 transfers some of the mercury 32 from the contact 36 to the contact 23. Electrical contact is made but, particularly, broken through the mercury 32 rather than by actual separation of the contacts 23 and 36. Consequently, any arcing takes place across mercury surfaces; and to the extent that the mercury evaporates, it is replaced from the pool at the bottom of the sleeve 12. The mercury-wetted sealed contact switch 11 consequently has a generally greater current switching capacity than a typical dry contact switch of similar size.

Another advantage of the mercury-wetted sealed contact switch is the damping of contact bounce which normally tends to occur upon an abrupt stop of the armature 17 as it engages the contact 23. The kinetic energy in the armature 17 tends to open the contacts 23 and 36 briefly as a result of vibrations, even against an urging force holding the contacts together in the operated position of the armature 17. The mercury 32 tends to string to bridge small gaps which occur during such bounce to clamp the vibrations and actually prevent a reopening of the contacts after an initial closure.

Closing and opening of the contacts occurs in response to an application and a corresponding removal of a substantially longitudinal magnetic field through the terminals 14 and 15 through the armature 17. The field is brought about by the energization, in a customary manner of an electric coil 37 surrounding the switch 11. In operating a prior art switch similar to the described switch 11, considerable vibrations of the armature occurred. These vibrations resulted particularly in reclosing and reopening the electrical connection between the contact 36 and the contact 23 upon deenergization of the coil 37, e.g., the opening of the switch. The switch 11 when subject to such vibrations or contact bounce is not acceptable for electronic operations wherein, for instance, each change of state in the switch, e.g., each reclosing and reopening, represents a distinct signal input that is counted as a separate operation of the switch 11. These additional signals are not based on a logic input to the coil 37, therefore they erroneously alter the count of the switch operations.

DESCRIPTION OF THE PREFERRED EMBODIMENT

Figure 2:
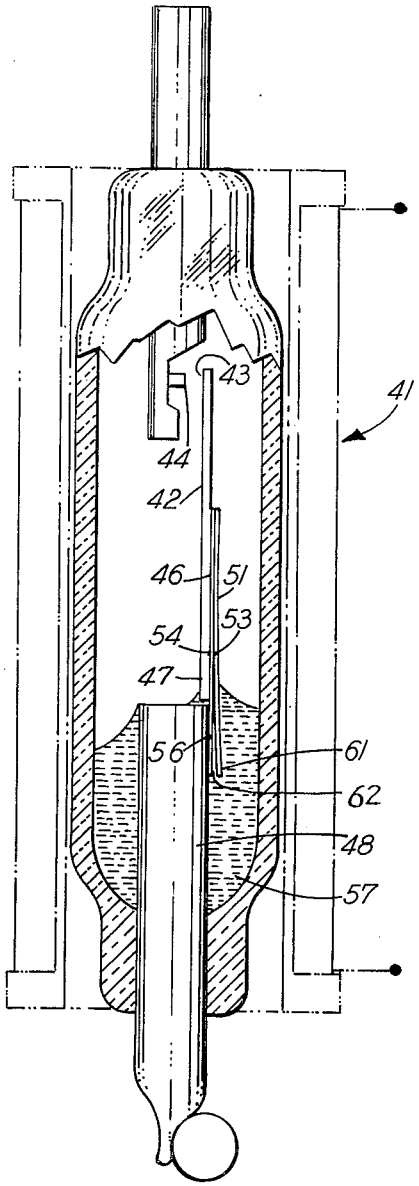
FIG. 2 is an enlarged sectional view of a miniature sealed contact switch which has been modified from the one of FIG. 1 in accordance with the present invention.

FIG. 2 depicts a switch, designated generally by the numeral 41, which is in many respects similar to the switch 11; however, in its operation the contact bounce has been eliminated. Similarly to the prior art switch 11, the switch 41 includes a pivotally mounted armature 42. A free end surface 43 of the armature 42 swings into and out of engagement with a contact 44 as the armature 42 becomes magnetically energized in the customary manner. The armature 42 pivots about a center or axis which is established by the flexure of a reed spring 46. The spring 46 is welded at one end to a lower end 47 of the armature 41 and at the end to a bottom terminal 48.

Figure 3:
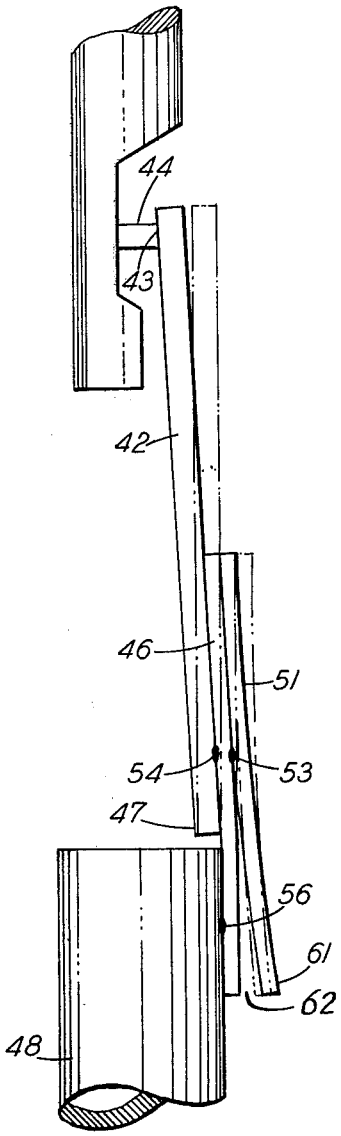
FIG. 3 shows an armature of the switch of FIG. 2 in its energized or operated position, and an alternate position in phantom lines showing a released or unoperated condition of the armature, as in FIG. 2, for comparison.

In reference to FIG. 2, a distinction of the switch 41 over the switch 11 is the presence of a reed 51 which is welded to the lower end 47 of the armature in substantial superposition to the spring 46. In a preferred embodiment shown in FIGS. 2 and 3 the reed 51 is of substantially the same size, shape and material as the spring 46. The reed 51 is actually attached to the spring 46 only at a spot weld 53 which is located in superposition to spot weld 54 between the spring 46 and the armature 42. The spring 46 and the reed 51 preferably become welded to the armature 42 during the same operation, so that the two spot welds 53 and 54 are formed simultaneously.

It has been found that welding the reed 51 in superposition to the spring 46 cured a problem of contact bounce for the switch 41 that previously had existed in the switch 11. An exact theory as to how the reed 51 functions to dampen the vibrations of the armature is not advanced. However, it is believed that the reed 51 transfers energy to the mercury. The mercury functions as a damping liquid to dissipate the transferred energy. In referring to FIGS. 2 and 3, the reed 51 as a damping member increases the inertia of the armature by only a small amount.

For instance, the reed is attached near the lower end 47 of the armature 42, and actually extends past the pivot axis of the armature 42 to a position across from the pivot axis. Consequently, the reed 51 is actually lumped about the center of rotation and adds little inertia to the normal operation of the armature 42. However, in any pivotal movement of the armature about the contact 44, which is likely to occur in storing or releasing additional energy resulting in contact bounce, the moment of inertia of the reed 51 becomes a maximum.

Furthermore, since an unattached end 61 of the reed 51 extends into the pool of mercury 57, a movement of the end 61 exerts a resistive force against the mercury. The inertia of the mercury, therefore, becomes significant in damping vibrations which are caused or amplified by any movement of the lower end 47 of the armature about the contact 44, and by an increased excursion of the reed 51 as a result of such movement.

Another advantage which may contribute to the damping of vibrations in the armature is the superposition of the reed 51 on a substantial length of the spring 46. It is believed that the gap 62 between the spring 46 and the reed 51, while it increases toward the unattached end 61 of the reed 51 is substantially filled with mercury by capillary attraction. The reed 51 may therefore absorb and damp vibrations of the spring 47 itself without affecting the flexibility of the spring 46. Such vibrations, transferred to the reed cause the free end of the reed to vibrate. The vibrations of the reed 51, however, become damped by the mercury. If not damped, the energy of such vibrations could otherwise be retransmitted to the armature 42 to cause contact bounce at the contact end surface 43 of the armature.

While it is preferred to make the reed 51 of similar material and of substantially the same size as the spring 46, changes in the size or in the material of the reed will not significantly alter its function or its beneficial results. However, any such changes should take into account possible effects on the damping. For instance, any material changes should, of course, take into account the compatibility of the new material with the switch 41 as an assembly. In addition, increases in mass or moments of inertia should be considered as slowing down the operating speed of the switch 41.

Other changes and modifications to the switch 41 may also be made without affecting the spirit and scope of this invention. And while the invention has been described with respect to a mercury-wetted sealed contact switch, it should be understood that the invention is believed to have other applications. For instance, a switch known as "dry reed switch" which becomes subject to contact bounce in certain applications may be modified in accordance with the present invention. It is not necessary that the damping liquid be a conductive liquid like mercury. It is also not necessary within the scope of this invention that the liquid should wet the contacts. A damping liquid can be a viscous substance coupled to the unattached end of the damping member. This viscous substance will absorb vibratory energy of the damping member to damp armature vibrations. The invention is consequently intended to be limited only by the scope of the following claims.

What is claimed is:

1. An electrical switch, which comprises:

a pair of spaced electrical terminals mounted in a sealed envelope;

a reed spring being bonded at one end thereof to one of the terminals, the spring extending from the one of the terminals toward the other of the terminals;

an armature having first and second ends, the first end of the armature located adjacent the one of the terminals, the armature extending substantially between the one and the other of the terminals in parallel and adjacent to the spring, the armature pivotally mounted through a bond located between the spring and the armature and adjacent to the first end of the armature, the second end of the armature located freely adjacent to the other of the terminals, for movement about an axis coinciding substantially with the center of flexure of the spring, located between the two bonded portions thereof, and for movement into engagement with a stop located on the other of the terminals and in the path of movement of the armature, the stop being electrically conductive, to establish electrical contact between said terminals upon the armature having moved to engage the stop;

a supply of liquid for damping the armature, located in said envelope, the axis being substantially interposed between the armature and the supply of liquid; and a reed rigidly coupled to the reed spring at at least one point, the reed being substantially superimposed on the spring, and extending from the armature past the axis into the supply of liquid, whereby the reed imparts a force on the liquid in response to a movement of the armature.

2. An electrical switch according to claim 1, wherein the stop is a contact mounted to the other of the terminals, the damping liquid consists essentially of mercury located in a pool about the one of the terminals, and the reed having a substantially flat end located in the pool of mercury said end of the reed located to form a gap between the reed and the spring, the gap being of decreasing width toward the coupling of the reed to the spring.

3. An electrical switch according to claim 1, wherein the reed is bonded to the spring at a point coincident with the bond between the spring and the armature, thereby being rigidly coupled to the armature through the spring and the bond between the spring and the armature.

4. An electrical switch comprising: first and second terminals mounted in a sealed envelope; an elastically flexible member attached at one end to the first terminal and extending therefrom;

an armature attached at one end to the flexible member and located generally between the terminals, the other end of the armature remaining unattached to permit the armature to pivot about a center of flexure of the member into and out of electrical contact with the second terminal, the center of flexure being located substantially at the midpoint between the attachments of the flexible member to the first terminal and to the armature;

a damping member mounted on said flexible member and shaped to be substantially superimposed on and parallel to the flexible member and extending part the one end of the armature toward and past the center of the flexure, the damping member having a flat end surface located on the opposite side of the center of flexure with respect to the unattached end of the armature; and a damping liquid located in said envelope at the first terminal, the damping member extending into the liquid to exert a force on the liquid in response to a force transmitted from the armature to the damping member.

* * * * *

UNITED STATES PATENT OFFICE

CERTIFICATE OF CORRECTION

PATENT NO. : 4,114,006

DATED : 9/12/78

INVENTOR(S) : Anthony Tedeschi

It is certified that error appears in the above-identified patent and that said Letters Patent are hereby corrected as shown below:

Col. 2, line 37, before "FIG. 1" insert --In--.

Col. 4, line 15, before "end" insert --other--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*